US007038563B2

(12) United States Patent
Andoh et al.

(10) Patent No.: US 7,038,563 B2
(45) Date of Patent: May 2, 2006

(54) ELECTROMAGNETIC SWITCH FOR STARTER

(75) Inventors: Kazuhiro Andoh, Okazaki (JP); Yasuyuki Wakahara, Kariya (JP); Masahiro Katoh, Chiryu (JP); Shinji Usami, Okazaki (JP); Tetsunori Inoguchi, Kosai (JP)

(73) Assignee: Denso Corporation, Kariya (JP)

( * ) Notice: Subject to any disclaimer, the term of this patent is extended or adjusted under 35 U.S.C. 154(b) by 2 days.

(21) Appl. No.: 10/790,830

(22) Filed: Mar. 3, 2004

(65) Prior Publication Data

US 2004/0169573 A1 Sep. 2, 2004

Related U.S. Application Data

(62) Division of application No. 10/103,730, filed on Mar. 25, 2002, now Pat. No. 6,762,663.

(30) Foreign Application Priority Data

Apr. 6, 2001 (JP) ..... 2001-109102
Jul. 19, 2001 (JP) ..... 2001-220299

(51) Int. Cl.
*H01H 67/02* (2006.01)

(52) U.S. Cl. ..... 335/126; 335/131

(58) Field of Classification Search ..... 335/126, 335/131; 336/192, 198
See application file for complete search history.

(56) References Cited

U.S. PATENT DOCUMENTS

| | | | | |
|---|---|---|---|---|
| 5,021,760 | A * | 6/1991 | Krubsack et al. | 335/196 |
| 5,423,117 | A * | 6/1995 | Okada et al. | 29/605 |
| 5,548,260 | A * | 8/1996 | Kogure et al. | 335/126 |
| 6,229,416 | B1 * | 5/2001 | Ebihara et al. | 335/131 |
| 6,590,487 | B1 * | 7/2003 | Uchiyama | 336/90 |
| 6,628,187 | B1 * | 9/2003 | Hashimoto et al. | 336/198 |
| 6,762,663 | B1 * | 7/2004 | Andoh et al. | 335/126 |

FOREIGN PATENT DOCUMENTS

| | | |
|---|---|---|
| JP | U 63-50432 | 4/1988 |
| JP | U 2-58304 | 4/1990 |
| JP | Y2 6-43977 | 11/1994 |

* cited by examiner

*Primary Examiner*—Lincoln Donovan
*Assistant Examiner*—Bernard Rojas
(74) *Attorney, Agent, or Firm*—Oliff & Berridge, PLC

(57) ABSTRACT

In an electromagnetic switch of a starter, a bobbin has two terminal holders on a flange. Each of the terminal holders defines a slot on its end surface and a terminal is press-fitted in the slot in an axial direction of the bobbin. An end of an excitation coil wound around the bobbin is pulled out the bobbin and connected to the terminal. A molded cover provides a through hole and is mounted on the terminal so that the terminal passes through the through hole. A sealing member is press-fitted on the terminal to air-tightly seal the through hole. A rod cover fitted on a rod supporting a movable contact has slits on its cylindrical part in the axial direction. The slits are closed before a distal end of the cylindrical part.

2 Claims, 9 Drawing Sheets

ELECTROMAGNETIC SWITCH FOR STARTER

This is a Division of application Ser. No. 10/103,730 filed Mar. 25, 2002 now U.S. Pat. No. 6,762,663. The entire disclosure of the prior application is hereby incorporated by reference herein in its entirety.

CROSS REFERENCE TO RELATED APPLICATION

This application is based on Japanese Patent Applications No. 2001-109102 filed on Apr. 6, 2001, and No. 2001-220299 filed on Jul. 19, 2001, the disclosure of which is incorporated herein by reference.

FIELD OF THE INVENTION

The present invention relates to an electromagnetic switch used in a starter for starting an internal combustion engine.

BACKGROUND OF THE INVENTION

According to an electromagnetic switch in JP-U-63-50432, a sealing member 120 is compressively fitted in a recess 110 formed on the inner wall of a molded cover 100, as shown in FIG. 10. A lead wire 140 of a coil is pulled out of the molded cover 100 through a through hole 130 of the molded cover 100 and a through hole in the sealing member 120. An end of the lead wire 140 pulled out of the molded cover 100 is soldered with a terminal 150 fixed on the molded cover 100. The through hole 130 of the molded cover 100 is sealed with solder 160 in order to secure air-tightness of the molded cover 100. In this electromagnetic switch, the lead wire 140 has to be manually pulled out of the molded cover 100 because the lead wire 140 does not have rigidity. Further, the air-tightness is influenced by a soldering quality.

Incidentally, in this kind of electromagnetic switch, a return spring is slidablly mounted on the outer periphery of a rod supporting a movable contact. However, the return spring is likely to be interfered around the rod when it is mounted onto the rod and when it slides on the rod.

SUMMARY OF THE INVENTION

The present invention is made in view of the above problems, and it is an object to provide an electromagnetic switch for a starter, which is capable of being automatically assembled.

It is another object to provide an electromagnetic switch for a starter, which is capable of being automatically assembled and providing air-tightness.

It is further another object to provide an electromagnetic switch for a starter in which a return spring is properly mounted without being interfered.

It is still another object to improve mountability and slidability of the return spring.

According to an aspect of the present invention, in an electromagnetic switch for a starter, a plate-like terminal having rigidity is press-fitted in a bobbin in an axial direction, and an end of an excitation coil wound around the bobbin is connected to the terminal. A cover is mounted such that the terminal passes through the cover.

In this structure, the terminal connected to the excitation coil extends out the molded cover, instead of pulling the excitation coil without having rigidity out of the molded cover. Therefore, steps up to fixing the molded cover can be automatically operated in an assembly process.

According to another aspect of the present invention, a rod supporting a movable contact at an end is movable with a plunger through a return spring in an axial direction. The rod has an annular groove on its outer circumferential surface and a rod cover is fitted on the rod. The rod cover has a flange, a cylindrical part and a distal end opposite to the flange. The cylindrical part has a plurality of projections which project inwardly from the inner circumferential surface of the cylindrical part to be fitted in the annular groove. The plurality of projections is arranged in the circumferential direction. The cylindrical part defines a plurality of slits that extend in the axial direction between the adjacent projections and is closed before the distal end.

In this structure, the cylindrical part other than the distal end of the rod cover can expands radially outward while the plurality of projections is passing on the outer periphery of the rod and before it is fitted in the annular groove when the rod cover is mounted onto the rod. Therefore, the rod cover is properly mounted onto the rod. In addition, since plurality of slits is closed before the distal end and the distal end has an annular shape, the distal end of the cylindrical part is restricted from expanding radially outward so that the cylindrical part remains its original shape after the rod cover is fitted on the rod. The return spring is mounted onto the rod cover by being guided by the outer circumferential surface of the cylindrical part from its distal end side, as a guide surface. Therefore, it is restricted that the return spring is caught in the plurality of slits of the rod cover. Accordingly, the return spring is properly mounted onto and slidable on the rod cover.

BRIEF DESCRIPTION OF THE DRAWINGS

Other objects, features and advantages of an embodiment will become more apparent from the following detailed description made with reference to the accompanying drawings, in which.

DETAILED DESCRIPTION OF PREFERRED EMBODIMENT

Embodiments of the present invention are described hereinafter with reference to drawings.

Figure 1:
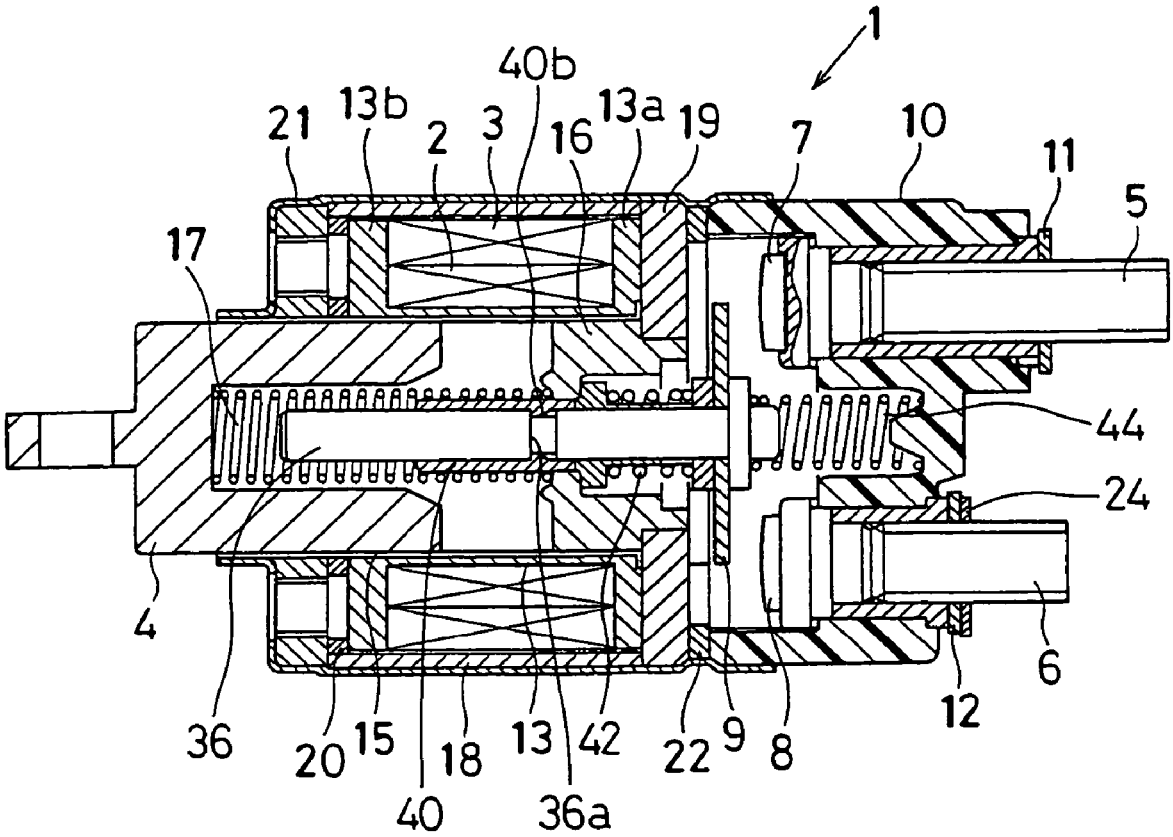
FIG. 1 is a cross-sectional view of an electromagnetic switch taken along in an axial direction, according to a first embodiment of the present invention.

An electromagnetic switch 1 of the embodiment turns on/off a main contact (described later) provided on a motor electric circuit of a starter (not shown). As shown in FIG. 1, the electromagnetic switch 1 has excitation coils 2 and 3, a plunger 4 and the like. When electric current is supplied to the excitation coils 2 and 3, the excitation coils 2 and 3 generate magnetic force. With this magnetic force, the plunger 4 moves in an axial direction of the excitation coils (right/left direction in FIG. 1).

The main contact has a pair of fixed contacts 7 and 8 and a movable contact 9. The movable contact 9 is movable with the plunger 4*a*. The fixed contacts 7 and 8 are respectively provided on heads of two terminal bolts called a battery terminal 5 and a motor terminal 6, inside a molded cover 10. The battery terminal 5 and the motor terminal 6 pass through the molded cover 10 and are fixed with washers 11 and 12 outside of the molded cover 10. The battery terminal 5 is connected with a cable (not shown) from a battery and the motor terminal 6 is connected with a lead wire (not shown) that supplies power to the starter.

Figure 2B:
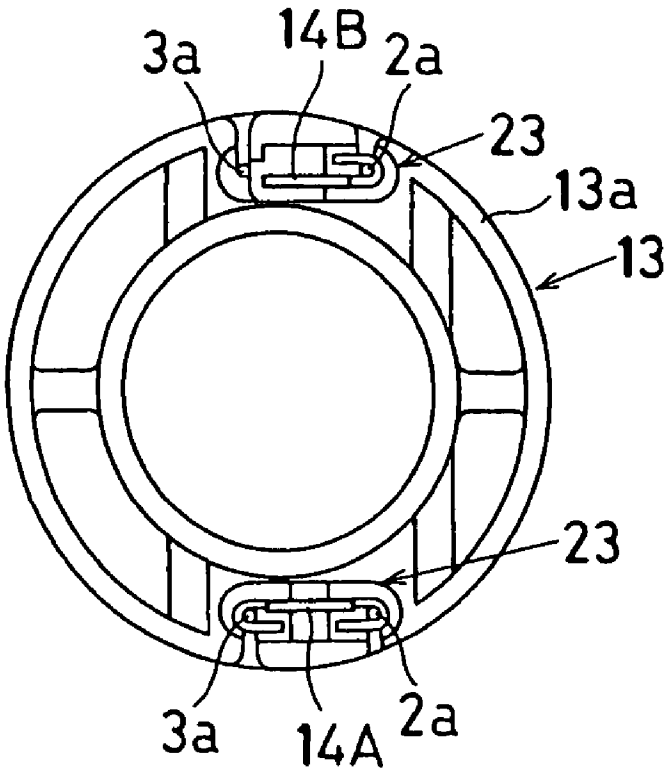
FIG. 2B is an axial end view of the bobbin.
Figure 2A:
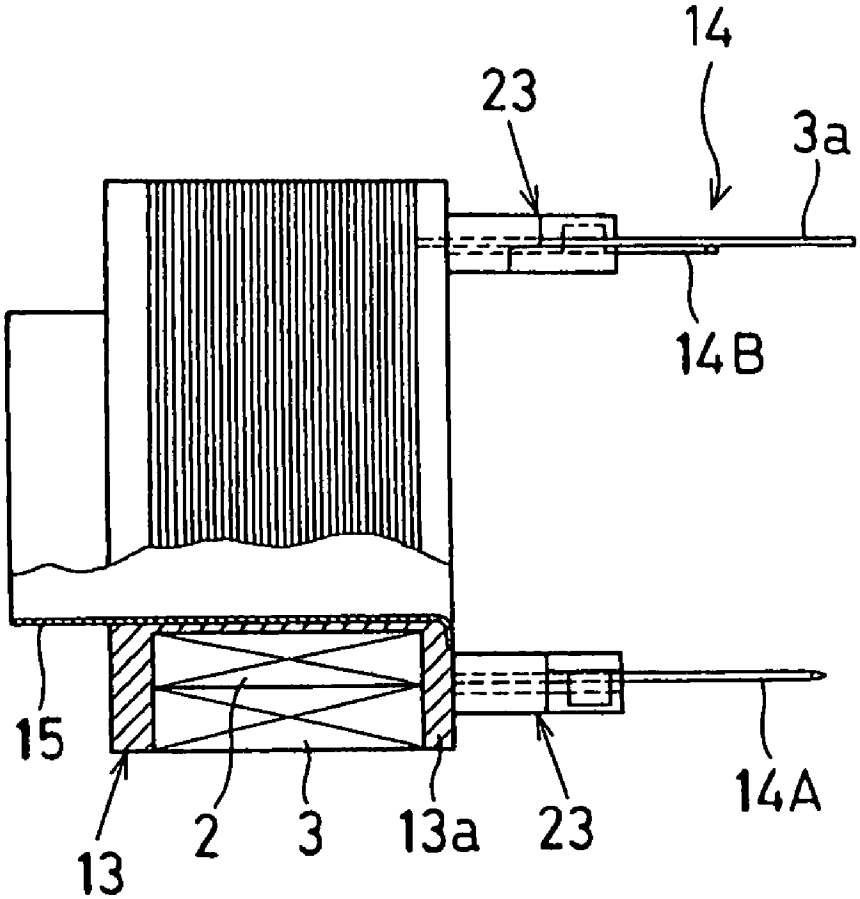
FIG. 2A is a side view of a coil wound around a bobbin of the electromagnetic switch including a partial cross-section.

The excitation coils 2 and 3 are wound around a bobbin 13 in a double-layered manner. The excitation coil 2 is an attracting coil that mainly generates magnetomotive force for pulling the plunger 4. The excitation coil 3 is a holding coil that mainly generates magnetomotive force for holding the plunger 4 after the main contact closes. A terminal 14 (described later) is attached to the bobbin 13, as shown in FIG. 2A. A lead wire 2*a* of the attracting coil 2 and a lead wire 3*a* of the holding coil 3 are connected to the terminal 14. A cylindrical sleeve 15 is provided on the inner periphery of the bobbin 13 to guide the plunger 4, so the plunger 4 is slidable in the bobbin 13 in the axial direction. In the cylindrical sleeve 15, a stator core 16 is arranged opposite to the plunger 4 in the axial direction, and a return spring 17 is provided between the plunger 4 and the stator core 16. The plunger 4 is biased to a left side in FIG. 1 by the return spring 17.

Figure 3B:
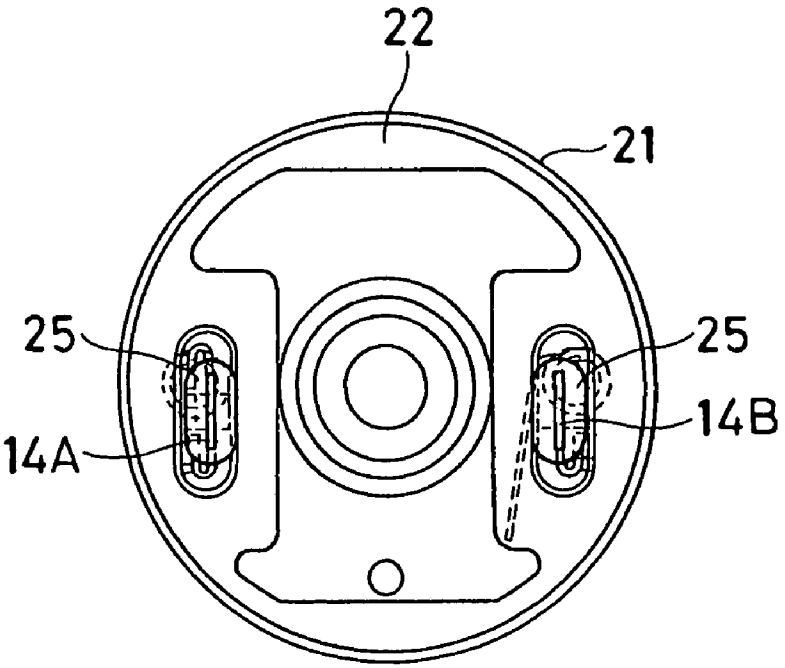
FIG. 3B is an axial end view of the switch case.
Figure 3A:
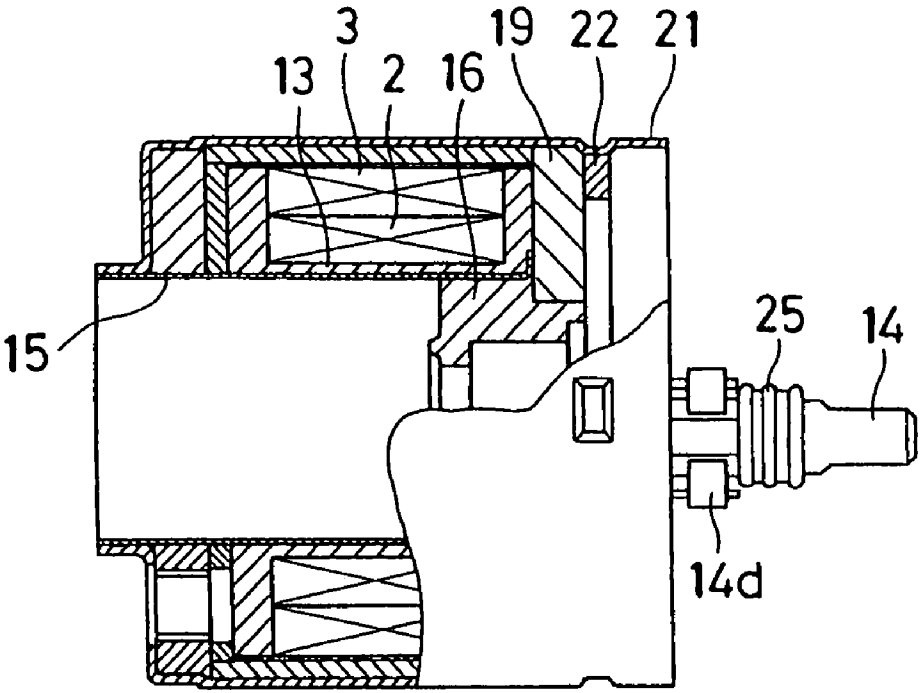
FIG. 3A is a side view of a switch case and a terminal including a partial cross-section.

The stator core 16 provides a magnetic circuit for guiding magnetic flux, with a yoke 18, a ground plate 19, a magnetic plate 20 and the like. These components are housed in a switch case 21, as shown in FIGS. 1 and 3A. The yoke 18 surrounds the excitation coils 2 and 3. The ground plate 19 and the magnetic plate 20 are respectively arranged adjacent to flanges 13*a* and 13*b* of the bobbin 13.

The molded cover 10 is assembled in the axial direction (from a right side in FIG. 1) against the ground plate 19 and a packing 22 is sandwiched between the ground plate 19 and the molded cover 10. An end of the switch case 21 is deformed inwardly to fix the molded cover 10.

Next, detailed structures of the terminal 14 and the bobbin 13 are described.

The terminal 14 includes a first terminal 14A and a second terminal 14B. The flange 13*a* of the bobbin 13 has two terminal holders 23 for fixing the terminals 14A and 14B, as shown in FIGS. 2A, and 2B. The terminal holders 23 protrude from the flange 13*a* in the axial direction, and are arranged to oppose to each other in a radial direction of the flange 13*a*. In a state that the bobbin 13 is disposed in the switch case 21, the terminal holders 23 project from an open end of the switch case 21 in the axial direction.

Figure 5:
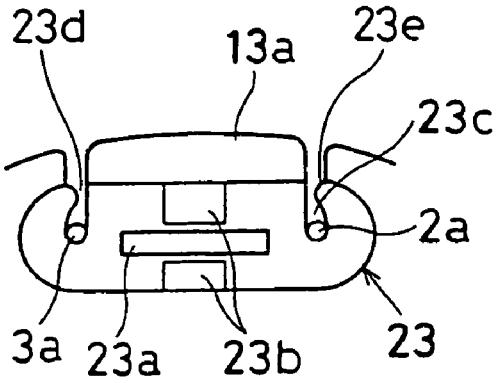
FIG. 5 is an axial end view of a terminal holder provided on a flange of the bobbin.

Each of the terminal holders 23 provides a slot 23*a* on its axial end surface to receive an end of the terminal 14, as shown in FIG. 5. The terminal holder 23 provides longitudinal wall portions 23*b* to restrict the terminal 14 from moving in its thickness direction. The longitudinal wall portions 23*b* protrude in the axial direction on both sides of the slot 23*a*. Further, the terminal holder 23 has lead wire holding slits 23*c* on its side surface, so the lead wires 2*a* and 3*a* are pulled out the bobbin 13 and held in the slits 23*c*. An inner side wall 23*e* defining the slit 23*c* inwardly protrudes such that a width of an opening 23*d* of the slit 23*c* is slightly narrower than a diameter of the lead wires 2*a* and 3*a*. Thus, the lead wires 2*a* and 3*a* are not easily removed from the slits 23*c*.

Figure 4A:
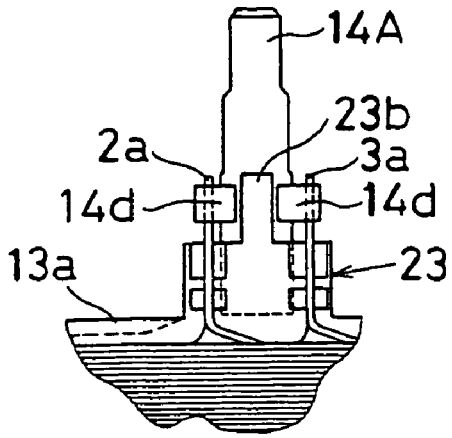
FIG. 4A is a side view of a first terminal press-fitted in the bobbin.
Figure 4B:
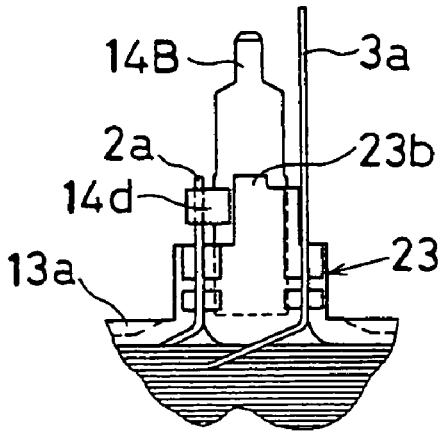
FIG. 4B is a side view of a second terminal press-fitted in the bobbin.
Figure 6:
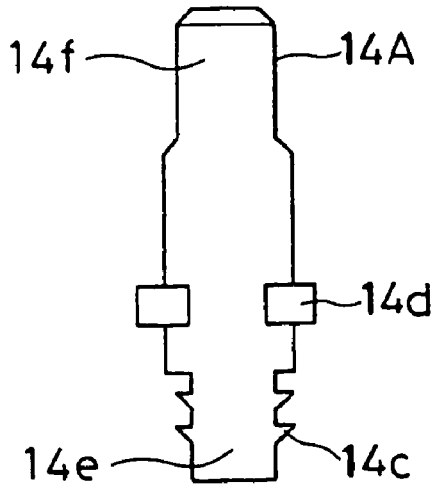
FIG. 6 is a side view of the first terminal.
Figure 9:
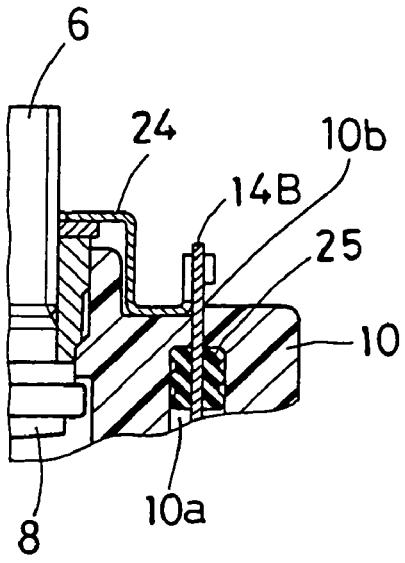
FIG. 9 is a partial cross-sectional view of the second terminal penetrated through a molded cover.
Figure 10:
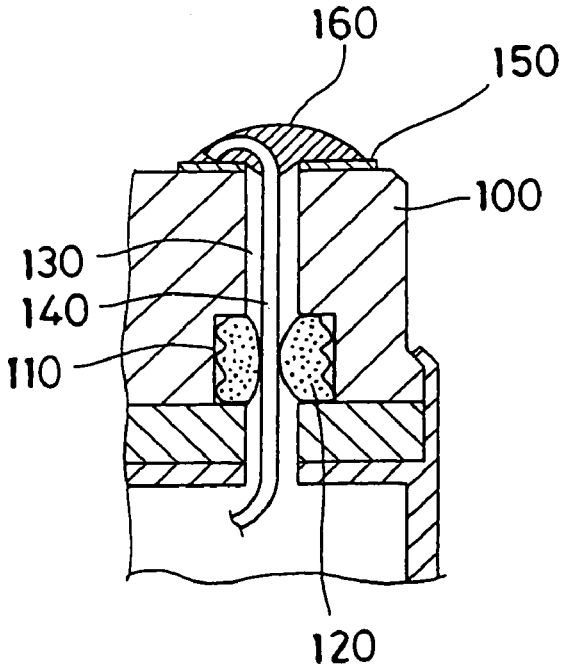
FIG. 10 PRIOR ART
FIG. 10 is a partial cross-sectional view of a lead wire pulled out a molded cover of a prior art.

The first terminal 14A is connected with a lead wire (not shown) connected to the starter switch. The second terminal 14B is connected to the motor terminal 6 through a conducting plate 24, as shown in FIG. 9. The first and the second terminals 14A and 14B are press-fitted in the slots 23*a* of the terminal holders 23, as shown in FIGS. 4A and 4B Each of the terminals 14A and 14B has a plate-like shape having a predetermined length, as shown in FIG. 6. Here, a bottom end (bottom side in FIG. 6) of the terminal 14, which is press-fitted in the slot 23*a* is referred to as a first end 14*e* and a top end of the same is referred to a second end 14*f*. The first end 14*e* has serrated portions 14*c* on its longitudinal side edges or on its outer periphery, so the terminal 14 is firmly fitted in the slot 23*a*.

Figure 7:
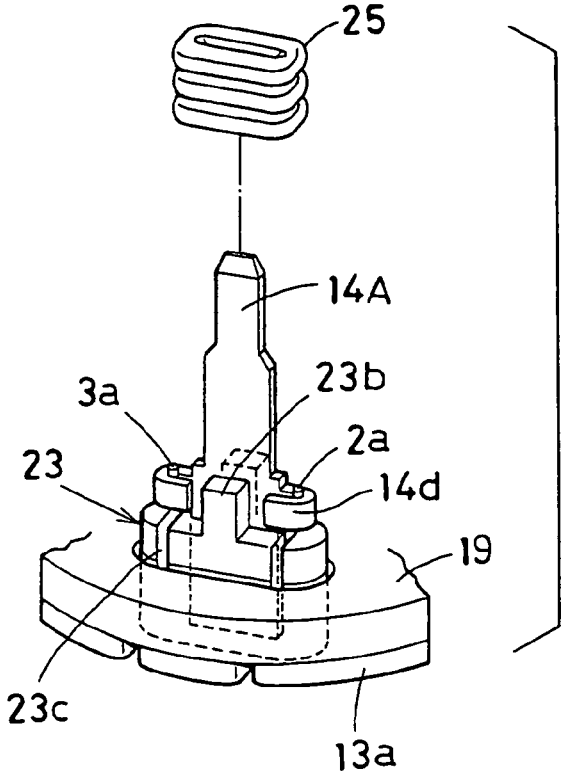
FIG. 7 is a perspective view of the terminal holder and a sealing member press-fitted on the first terminal.

The terminal 14 has at least one arm portion 14*d* on its longitudinal edge above the serrated portion 14*c* to fasten the lead wires 2*a* and 3*a*. The arm portion 14*d* is made by folding an extended portion of the terminal 14 so as to hold the lead wires 2*a* and 3*a*, as shown in FIG. 7. The first terminal 14A has two arm portions 14*d*, as shown in FIG. 4A. The second terminal 14B has one arm portion 14*d*, as shown in FIG. 4B.

The lead wires 2*a* and 3*a* are connected to the terminal 14 in the following manner. As shown in FIGS. 4A to 5, the lead wires 2*a* and 3*a* are pulled out the bobbin 13 and held in the lead wire holding slits 23*c*. Then, each end of the lead wires 2*a* and 3*a* is fastened in the arm portion 14*d*, and connected to the terminal 14 by welding or the like. More specifically, in the first terminal 14A, the lead wires 2*a* and 3*a* are fastened and connected to the arm portions 14*d*, as shown in FIG. 4A. In the second terminal 14B, only the lead wire 2*a* is fastened and connected to the arm portion 14*d*, as shown in FIG. 4B, and the remaining end of the lead wire 3*a* is held in the lead wire holding slit 23*c* and fixed on the surface of the ground plate 19 by welding or the like.

Figure 8A:
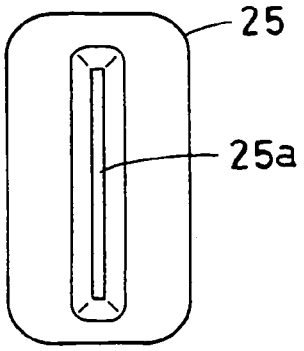
FIG. 8A is an end view of the sealing member.
Figure 8B:
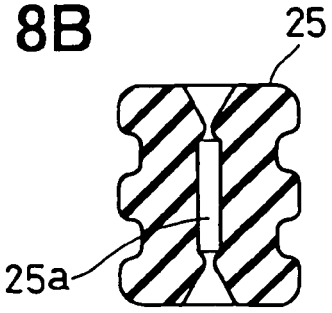
FIG. 8B is a cross-sectional view of the sealing member.
Figure 8C:
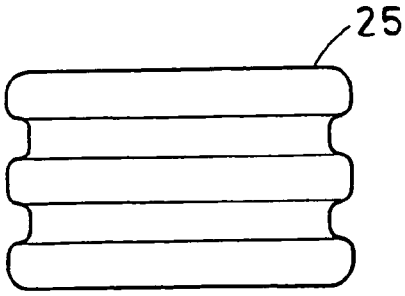
FIG. 8C is a side view of the sealing member.

A sealing structure of the molded cover 10 is described hereinafter. The molded cover 10 has a through hole 10*b* allowing the terminal 14 to pass through. As shown in FIG. 9, the terminal 14 passes through and the second end of the terminal 14 extends out of the molded cover 10. A sealing member 25 is press-fitted to each terminal 14 to air-tightly seal a clearance between the molded cover 10 and the terminal 14. The sealing member 25 is, for example, made of rubber. The sealing member 25 is a ring-shaped having a through hole 25*a* in the middle, and has projections on its outer peripheral surface, as shown in FIGS. 8A to 8C.

The terminal 14 is inserted into the through hole 25*a* so that the sealing member 25 is tightly fitted on the outer periphery of the terminal 14, as shown in FIG. 3A. When the molded cover 10 is mounted, the sealing member 25 is disposed and pressed in the recess 10*a* provided inside the molded cover 10, as shown in FIG. 9. The projections of the outer peripheral surface of the sealing member 25 tightly contact the inner peripheral surface of the recess 10*a*. Accordingly, the clearance between the terminal 14 and the molded cover 10 is air-tightly sealed.

Next, detailed structures around the plunger 4 and the return spring 17 relating to the movable contact 9 are described hereinafter.

Figure 11B:
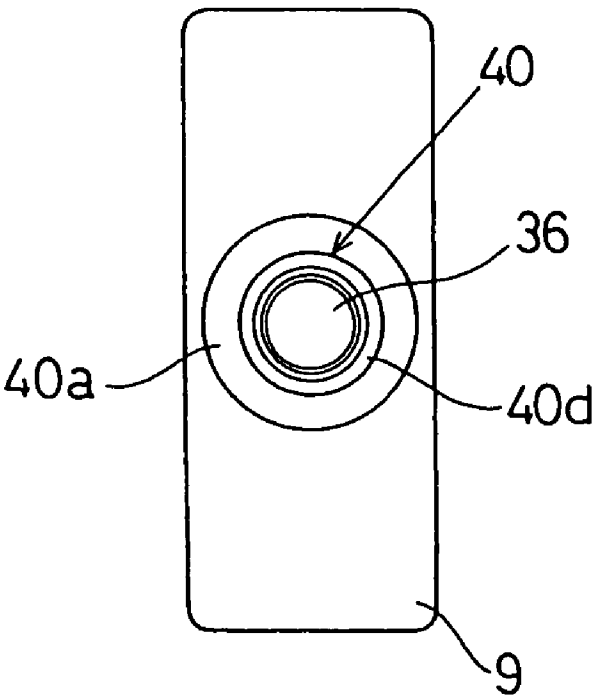
FIG. 11B is an end view of the subunit in FIG. 11A.
Figure 11A:
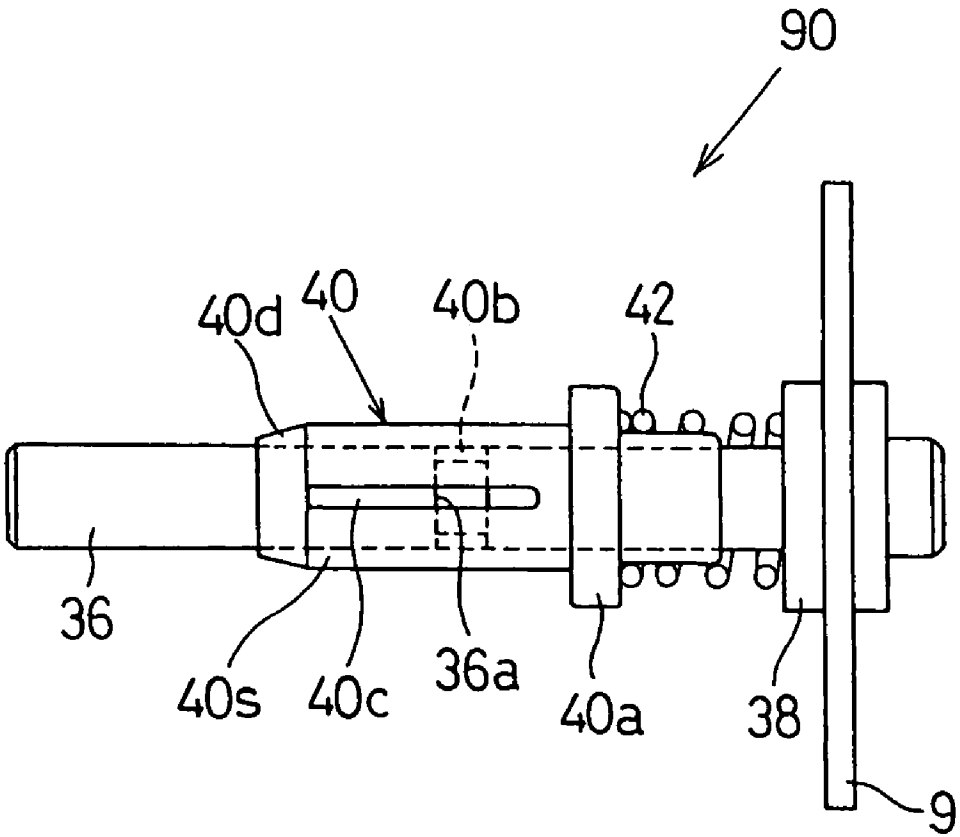
FIG. 11A is a side view of a subunit including a movable contact.

The movable contact 9 is supported on an insulator 38 (e.g. Bakelite) provided on the rod 36 in a slidable manner, as shown in FIGS. 11A and 11B. This movable contact 9 is assembled into a subunit 90 with a rod cover 40 and a contact spring 42. The rod 36 passes through the center of the stator core 16 and is slidable in the axial direction. The rod 36 is biased toward the plunger 4 (left side in FIG. 1) by a spring 44 provided between the rod 36 and the molded cover 10. While the plunger 4 is being attracted by the magnetomotive force generated in the attracting coil 2, the rod 36 is moved to the right side (in FIG. 1) with the plunger 4, and the spring 44 is compressed with the rod 36. When the magnetomotive force extinguishes, the rod 36 is sprung back to a stationary position shown in FIG. 1 by reactive force of the spring 44.

Figure 12A:
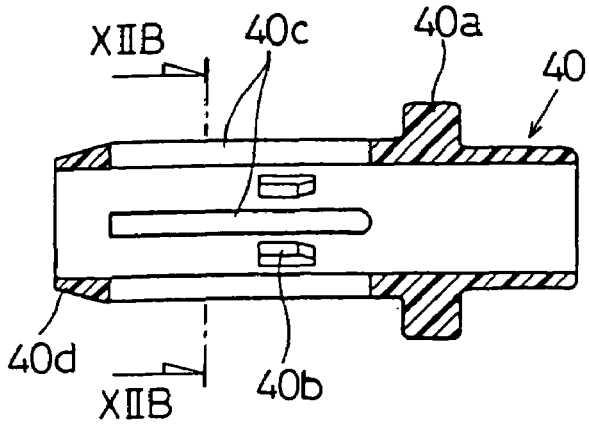
FIG. 12A is a cross-sectional view of a rod cover taken along in an axial direction.
Figure 12B:
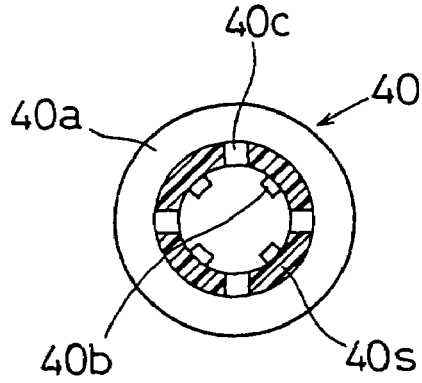
FIG. 12B is a cross-sectional view of the rod cover taken along line XIIB—XIIB.

The rod cover 40 is fitted on the outer circumferential surface of the rod 36, as shown in FIGS. 11A and 11B. The rod cover 40 is, for example, made of resin. A contact spring 42 is provided between a flange 40*a* of the rod cover 40 and the insulator 38. The contact spring 42 applies contact pressure to the movable contact 9 after the rod 36 moves with the plunger 4 and the movable contact 9 contacts the fixed contacts 7 and 8. Specifically, the rod cover 40 has a cylindrical part 40*s* and the flange 40*a*, as shown in FIGS. 12A and 12B. A plurality of projections 40*b* is provided to inwardly project from the inner circumferential surface of the cylindrical part 40*s* and arranged in a circumferential direction. The projections 40*b* fit in an annular groove 36*a* provided on the outer circumferential surface of the rod 36, so the rod cover 40 is restricted from moving in the axial direction with respect to the rod 36.

Slits 40*c* are provided on the cylindrical part 40*s*, as shown in FIGS. 12A and 12B. Each of the slits 40*c* is provided between adjacent projections 40*b* arranged in the circumferential direction, and extends in the axial direction. The slit 40*c* penetrates the cylindrical part 40*s* from the outer circumferential surface to the inner circumferential surface. The cylindrical part 40*s* includes an annular-shaped connecting portion 40*d* at its distal end (left side end in FIG. 12A), so the slits 40*c* are closed at the connecting portion 40*d*. The outer circumferential surface of the connecting portion 40*d* is tapered off to its distal end. That is, the outer diameter of the connecting portion 40*d* is decreased toward its distal end, to easily mount the return spring 17 onto the cylindrical part 40*s*.

The inner diameter of the return spring 17 is slightly larger than the outer diameter of the rod cover 40. The return spring 17 is mounted onto the rod cover 40 in the axial direction (from the left side in FIG. 12A). At this time, the outer circumferential surface of the cylindrical part 40*s* including the outer circumferential surface of the connecting portion 40*d* functions as a guide surface.

According to the above-described electromagnetic switch 1, the lead wires 2*a* and 3*a* are connected to the terminal 14 having rigidity. The terminal 14 passes through the molded cover 10 from an inside to an outside. That is, when the molded cover 10 is assembled, the second end 14*f* of the rigid terminal 14 can be extended out of the molded cover 10, instead of pulling the lead wires 2*a* and 3*a* that do not have rigidity out of the molded cover 10. Therefore, steps up to fixing the molded cover 10 can be automatically operated in an assembly process.

The bobbin 13 has the terminal holders 23 defining the slots 23*a* for receiving the terminals 14 A and 14B and the terminal holders 23 extend from the flange 13*a* in the axial direction of the bobbin 13. In this case, components such as the ground plate 19, packing 22, sealing member 25, and molded cover 10 are assembled in a longitudinal direction of the terminal 14, that is, the axial direction of the bobbin 13. Therefore, these components can be automatically assembled.

Further, each of the terminal holders 23 has the longitudinal wall portions 23*b* on both sides of the slot 23*a*. Therefore, the terminal 14 is restricted from moving in its thickness direction during the assembly. Accordingly, components such as the sealing member 25 and the molded cover 10 mounted in relative to the terminal 14 are easily assembled.

In addition, the terminal holder 23 has the lead wire holding slits 23*c*. Therefore, in the state that the lead wires 2*a* and 3*a* pulled out the bobbin 13 are held in the lead wire holding slits 23*c*, the ends of the lead wires 2*a* and 3*a* are fastened in the arm portions 14*d* of the terminal 14 and welded to the terminal 14. Accordingly, the lead wires 2*a* and 3*a* are easily handled and securely connected to the terminal 14 in a right position. As a result, poor connection of the lead wires 2*a* and 3*a* to the terminal 14 is reduced. In addition, the lead wires 2*a* and 3*a* do not disturb assembly of the ground plate 19. Therefore, the ground plate 19 can be assembled automatically.

In the electromagnetic switch 1, the ring-shaped sealing member 25 press-fitted to the terminal is used as the sealing structure of the molded cover 10. In this case, the sealing member 25 is securely fitted to the terminal 14. Therefore, the sealing member 25 is restricted from being moved when the molded cover 10 is assembled, thereby ensuring the sealing structure. Also, it is possible to automatically assemble the molded cover 10.

Furthermore, the longitudinal wall portions 23*b* are spaced apart equal to or slightly wider than the thickness of the terminal 14. Therefore, the movement of the terminal 14 in the thickness direction may be effectively decreased. Also, it is not always necessary to provide the two longitudinal wall portions 23*b*. For example, the terminal holder 23 may have at least one longitudinal wall portion, in order to restrict the terminal 14 from moving in the thickness direction during assembly. Also, the wall portion 23*b* may have any other shapes.

Since the terminal 14B does not have a second arm portion to fasten the lead wire 3*a*, the longitudinal wall portions 23*b* of the terminal holder 23 for the terminal 14B may be larger or wider than those for the terminal 14A, for example. Alternatively, it is possible to provide a single longitudinal wall portion having a different shape such that the longitudinal wall portion protrudes in the axial direction to surround the terminal 14B. According to these arrangements, it is effective not only to fix the terminal 14B steady to the terminal holder 23, but also to restrict the lead wire 3*a* connected to the ground plate 29 from short-circuiting by terminal 14B.

In the electromagnetic switch 1, the rod cover 40 has the plurality of slits 40*c* on the cylindrical part 40*s* in the axial direction. Therefore, when the projections 40*b* of the cylindrical part 40*s* are passing or moving on the outer periphery of the rod 36 in the axial direction while the rod cover 40 is mounted onto the rod 36, the cylindrical part 40*s* can expand radially outward. Accordingly, force required to press the rod cover 40 in the axial direction until the projections 40*b* fit in the annular groove 36*a* of the rod 36 can be reduced. In this way, the rod cover 40 is easily mounted onto the rod 36.

Figure 14B:
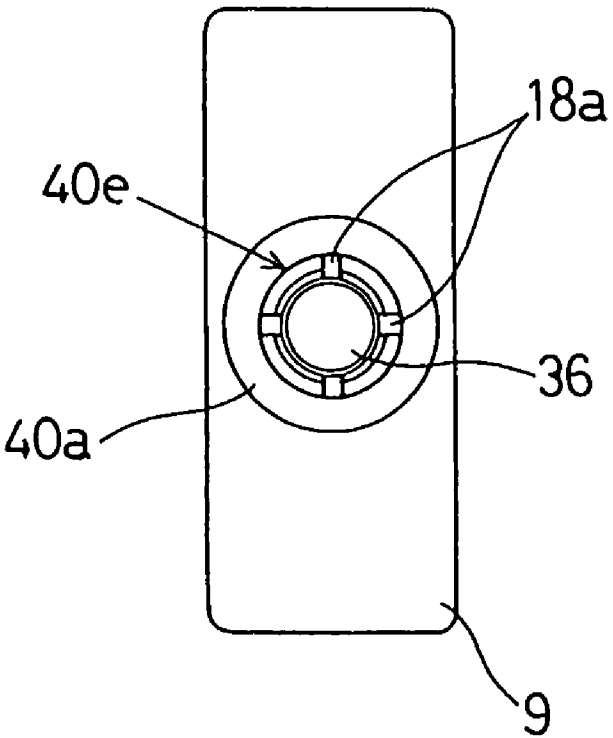
FIG. 14B is an end view of the subunit in FIG. 14A.
Figure 14A:
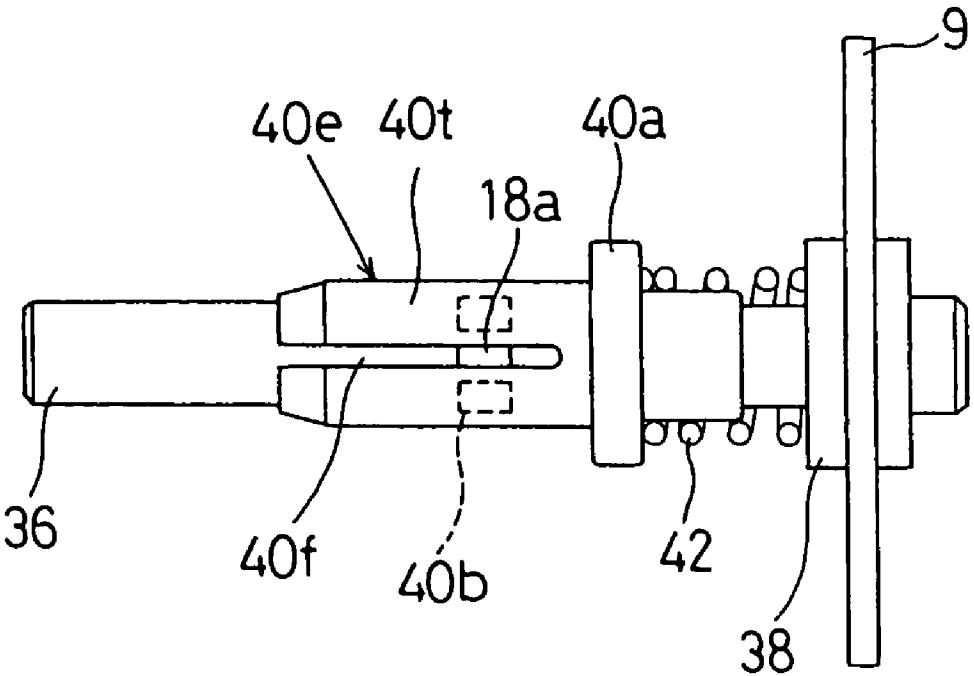
FIG. 14A is a side view of a subunit including a movable contact as a comparative embodiment.

Further, since the slits 40*c* are closed at the connecting portion 40*d*, the return spring 17 is more successfully mounted to onto the rod cover 40, as compared with a rod cover 40*e* shown in FIGS. 14A and 14B. In the rod cover 40*e*, for example, slits 40*f* are not closed at the distal end of the rod cover 40*e* and the cylindrical part 40*t* is separated into a plurality of resilient pieces. In the rod cover 40, however, since the slits 40*c* are closed at the connecting portion 40*d*, it is restricted that the return spring 17 is caught by the cylindrical part 40*s* of the rod cover, when it is mounted onto and slides on the rod cover 40.

Further, since the slits 40*c* are closed by the connecting portion 40*d*, the cylindrical part 40*s* of the rod cover 40 is restricted from excessively expanding radially outward when the rod cover 40 is mounted onto the rod 36. That is, the rod cover 40 is not deformed beyond its resilient range, but remains its original shape after the projections 40*b* fit in the annular groove 36*a*. Therefore, it is decreased that the return spring 17 presses the outer circumferential surface of the cylindrical part 40*s*. Accordingly, the return spring 17 is properly mounted onto the rod cover 40 and can slide on the rod cover 40 in the axial direction without being caught by the cylindrical part 40*s* or in the slits 40*c*.

(Second embodiment)

Figure 13:
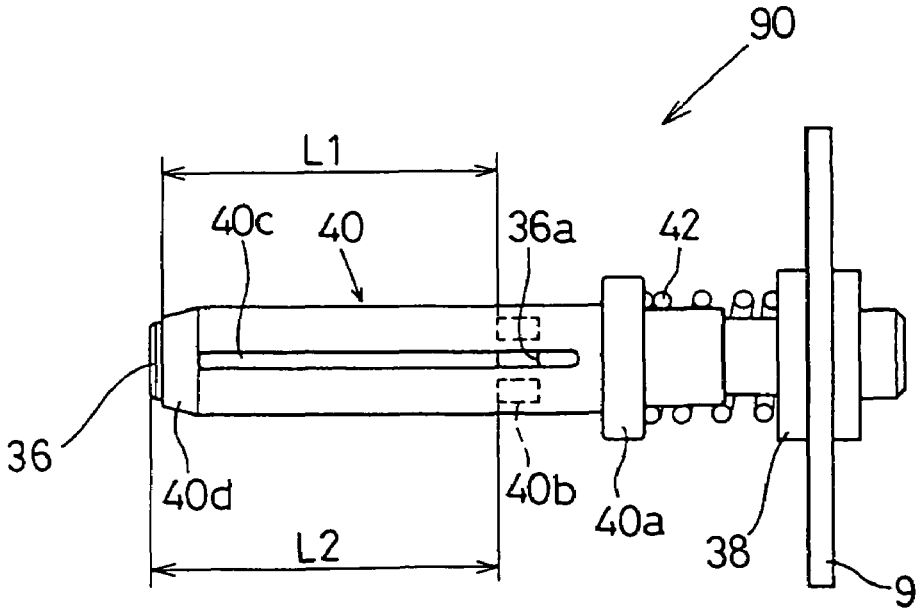
FIG. 13 is a side view of a subunit including a movable contact according to a second embodiment of the present invention.

An axial length of the rod cover 40 may be increased as compared with that of the first embodiment. Preferably, an axial length L1 of the rod cover 40 from the distal end to the projections 40*b* is substantially equal to an axial length L2 of the rod 36 from a distal end to the annular groove 36*a* thereof, as shown in FIG. 13.

With this arrangement, an axial length of the slits 40*c* can be increased in the axial direction as compared with that of the first embodiment. Therefore, the cylindrical part 40*s* of the rod cover 40 can easily expand radially outward when it is mounted onto the rod 36. Accordingly, the pressing force required to mount the rod cover 40 onto the rod 36 can be decreased. Since the axial length of the slits 40*c* is increased, the cylindrical part 40*s* becomes flexible more than that of the first embodiment. Therefore, the deformation of the cylindrical part 40*s* can be decreased, and the return spring 17 is properly mounted onto the rod cover 40.

The present invention should not be limited to the disclosed embodiments, but may be implemented in other ways without departing from the spirit of the invention.

What is claimed is:

1. An electromagnetic switch for a starter, comprising:

a bobbin;

a plate-like terminal having a first end and a second end, the first end being attached to the bobbin in an axial direction of the bobbin;

an excitation coil wound around the bobbin, an end of the excitation coil being pulled out the bobbin and connected to the terminal;

a cover mounted on the terminal, wherein the terminal passes through the cover in the axial direction;

a plunger which is slidablly provided in the bobbin in the axial direction and attracted in one way by magnetic force generated in the excitation coil;

a rod slidable in the bobbin in the axial direction with the plunger, the rod defining an annular groove on an outer circumferential surface and having a first end and a second end opposite to each other, the first end opposing the plunger; and a rod cover fitted on the rod and having a flange, a cylindrical part and a distal end opposite to the flange, the cylindrical part having a plurality of projections which project inwardly from an inner circumferential surface of the cylindrical part, are arranged in a circumferential direction, and are fitted in the annular groove, and the cylindrical part defining a plurality of slits each of which extends in the axial direction between the plurality of projections without reaching the distal end.

2. The electromagnetic switch for the starter according to claim 1, wherein an axial length of the cylindrical part from the plurality of projections to the distal end is substantially equal to an axial length of the rod from the annular groove to the first end.

* * * * *